US007788746B2

(12) United States Patent
Kuchel et al.

(10) Patent No.: US 7,788,746 B2
(45) Date of Patent: Sep. 7, 2010

(54) MATTRESS FOUNDATION WITH PERIMETER STRUCTURE

(75) Inventors: Bernhard W. Kuchel, King, NC (US); Eugen Constantinescu, Greensboro, NC (US)

(73) Assignee: Sealy Technology LLC, Trinity, NC (US)

( * ) Notice: Subject to any disclaimer, the term of this patent is extended or adjusted under 35 U.S.C. 154(b) by 225 days.

(21) Appl. No.: 11/784,458

(22) Filed: Apr. 6, 2007

(65) Prior Publication Data

US 2008/0244828 A1 Oct. 9, 2008

(51) Int. Cl.
*A47C 23/00* (2006.01)

(52) U.S. Cl. ..... 5/247; 5/717; 5/739

(58) Field of Classification Search ..... 5/239, 5/247, 255, 717, 739–740
See application file for complete search history.

(56) References Cited

U.S. PATENT DOCUMENTS

| | | | | |
|---|---|---|---|---|
| 3,401,411 | A | 9/1968 | Morrison | |
| 3,822,426 | A * | 7/1974 | Mistarz | 5/717 |
| 3,869,739 | A | 3/1975 | Klein | |
| 4,129,908 | A | 12/1978 | Wagner | |
| 4,181,991 | A | 1/1980 | Morgan et al. | |
| 5,113,539 | A | 5/1992 | Strell | |
| 5,133,116 | A | 7/1992 | Wagner et al. | |
| 5,210,890 | A * | 5/1993 | Hagglund | 5/239 |
| 5,327,596 | A | 7/1994 | Wallace et al. | |
| 5,467,488 | A | 11/1995 | Wagner | |
| 5,469,590 | A | 11/1995 | Simon | |
| 5,687,439 | A | 11/1997 | Wagner | |
| 6,263,533 | B1 | 7/2001 | Dimitry et al. | |
| 6,360,390 | B1 | 3/2002 | Bonaddio | |
| 6,406,009 | B1 * | 6/2002 | Constantinescu et al. | 267/81 |
| 6,540,214 | B2 | 4/2003 | Barber | |
| 6,588,035 | B2 | 7/2003 | LeDuc | |
| 6,883,196 | B2 | 4/2005 | Barber | |
| 7,047,581 | B2 | 5/2006 | Gladney | |
| 7,168,117 | B2 | 1/2007 | Gladney | |

* cited by examiner

*Primary Examiner*—Fredrick Conley
(74) *Attorney, Agent, or Firm*—James C. Scott; Roetzel & Andress

(57) ABSTRACT

A mattress foundation with a perimeter structure has a frame, springs mounted upon the frame, and a grid supported by the springs, and perimeter structure at a perimeter of the frame which extends from the frame to the grid, forming an exterior wall which extends from the frame to a border wire of the grid. When the perimeter structure is made of structural and reflexive material such as closed-cell foam, it co-acts with the grid and springs and provides additional support to the perimeter region of the grid and foundation. The exterior wall of the perimeter structure forms a solid surface over which padding or upholstery is placed.

27 Claims, 6 Drawing Sheets

MATTRESS FOUNDATION WITH PERIMETER STRUCTURE

RELATED APPLICATIONS

There are no pending applications related to this application.

FIELD OF THE INVENTION

The present invention is in the general field of support systems and structures, and more particularly in the field of support systems and structures.

BACKGROUND OF THE INVENTION

Conventional bedding systems commonly include a mattress positioned upon and supported by a foundation or "box spring". Foundations provide support and firmness to the mattress as well as some additional resilience in order to deflect under loads. Foundations are typically constructed of a frame, such as a rectangular frame including perimeter members and internal members or stringers, springs—such as steel wire springs—which are mounted upon the frame to extend upward from the frame and support a grid—such as a wire grid—above the frame. The grid serves as the primary structural support for the mattress, and in turn is flexibly supported by the springs. In order to adequately support the weight of the mattress and the loads placed upon the mattress, a dense distribution of springs is generally required. In conventional steel spring foundations, the springs are made of steel wire most commonly in torsion spring configurations, with bases or feet of the springs mounted directly to the interior frame members or stringers, and tops of the springs engaged with or otherwise fastened to the grid. The grid is typically a steel wire grid assembled with welds at orthogonal intersections of the wire and at a perimeter wire of heavier gauge.

Interestingly, although the perimeter or "border" wire of the grid is usually of substantially heavier gauge than the grid wires, in most foundations it is not directly supported by any of the springs, and as such is held by cantilevered support of the springs closest to the perimeter. As a result, such foundations actually provide the least reflexive vertical support at the perimeter region which contributes to the undesirable "roll-off" tendency, and is inadequate for the high perimeter loads when the edge of the mattress is used as a seat, which it frequently is. Although some efforts have been made to provide direct vertical support to the border wire, for example in the form of perimeter spring elements which extend from the perimeter frame members to the border wire, this can result in segments of the border wire which are less flexible than others, and adds component and manufacturing cost to the product.

SUMMARY OF THE INVENTION

The present invention and disclosure provides several improvements and advantages over prior art mattress foundations. In accordance with one concept and principle of the invention and disclosure, there is provided a mattress foundation which has an integral perimeter structure about a substantial perimeter of the foundation, wherein the perimeter structure includes one or more supporting flexible components which contact a frame of the foundation and border wire of a grid of the foundation. In one embodiment, a mattress foundation perimeter structure is made of one or more foam components which extend from a frame of the foundation to a border wire of the foundation. The foam components of the perimeter structure have at least some attributes of structural rigidity, flexure and resilience which cooperates with movement or deflection of the border wire and/or the grid.

In accordance with another aspect of the disclosure, a mattress foundation has a frame on which a plurality of spring elements are mounted, a grid supported above the frame by the spring elements, the grid having intersecting wires which are engaged by the springs and a border wire at a perimeter of the grid, and a perimeter wall structure which extends from the frame to the border wire. The perimeter wall structure is made of foam or other compressible material, and can be formed as a single molded structure which fits at the perimeter of a mattress foundation and extends from the frame to the grid of the mattress foundation, or alternatively can be made up of two or more foam components which fit together at the perimeter of the mattress foundation and which extend from the frame to the grid of the mattress foundation.

DETAILED DESCRIPTION OF PREFERRED AND ALTERNATE EMBODIMENTS

Figure 1:
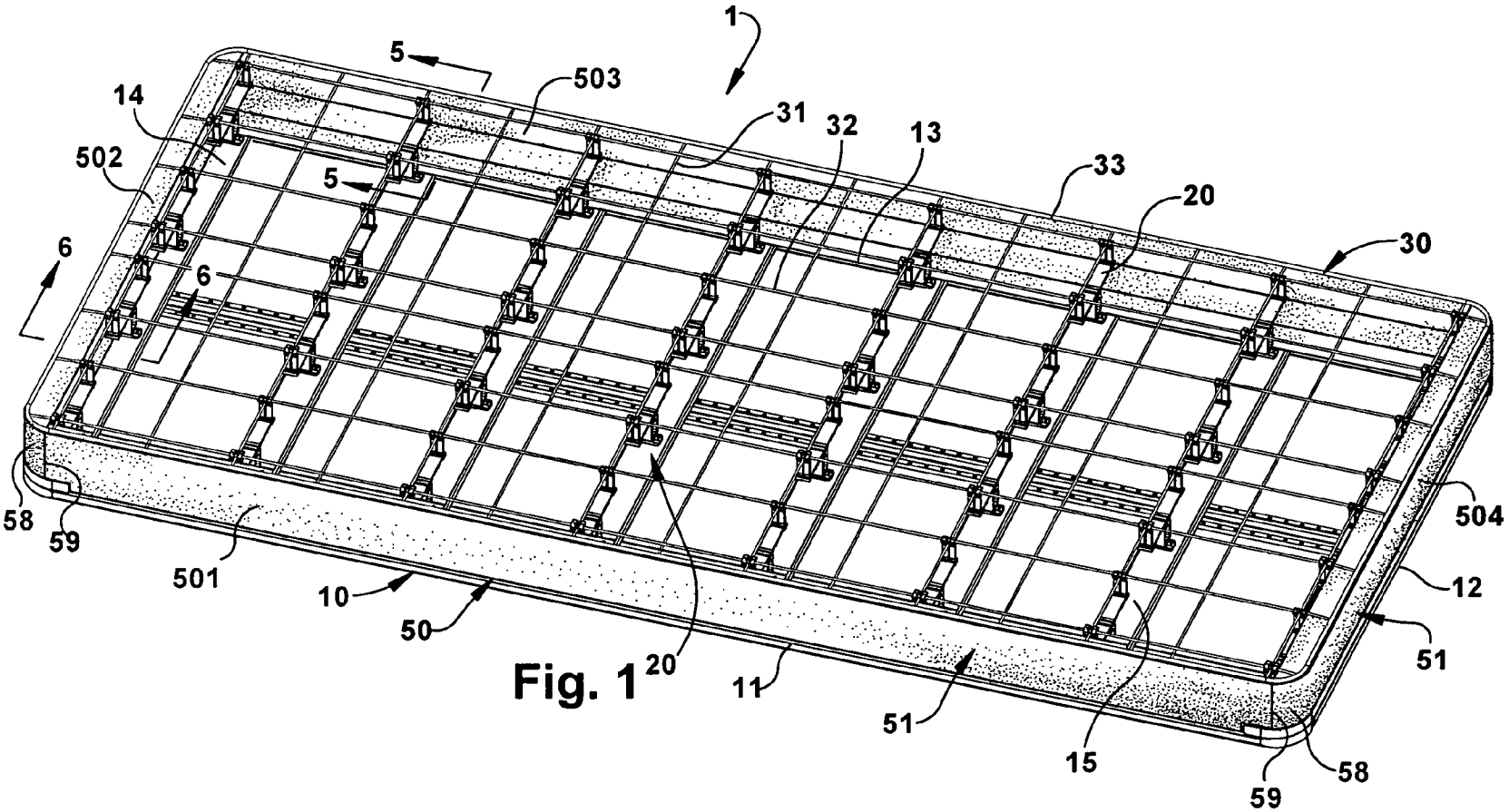
FIG. 1 is a perspective view of a mattress foundation of the disclosure.

As shown in FIG. 1, a mattress foundation, indicated generally at 1, has a frame, indicated in its entirety at 10, which includes perimeter members 11, 12, 13 and 14, and intermediate members 15, also referred to herein as "stringers". The intermediate members 15 are shown in a transverse orientation extending across a width of the frame 10 relative to the longitudinal length of the frame, but could be in any other arrangement within the perimeter members of the frame.

Mounted upon the intermediate members 15 of the frame are plurality of springs 20 which extend from the intermediate members 15 to an overlying grid, indicated in its entirety at 30. The grid 30 includes orthogonal intersecting rods or wires 31 and 32, and a border wire 33 which runs continuously about an entire perimeter of the grid 30. Although the grid 30 is shown in this particular configuration with the intersecting rods or wires 31, 32 in an orthogonal arrangement, other configurations of a grid which have some form of perimeter structure such as border wire 33, regardless of the arrangement or interconnection of the internal or intersecting rods or wires, can be used in accordance with the disclosure and invention.

As illustrated in FIGS. 1-6, the springs 20 are, in this particular embodiment, of a configuration which includes a base 21 which is mounted upon a supporting surface of an intermediate frame member 15, a spring body 22, and one or more spring arms 23 which extend from the spring body 22 to the grid 30 and engage or otherwise connect with or support one or more of the rods or wires 31, 32 (also referred to herein as "interior wires") of the grid 30. As shown, it is preferred that the springs 20 engage or otherwise support the grid 30 at the intersections of the intersecting rods or wires 31, 32. The foundation 1 may be constructed with other types of springs or support units. Although referred to herein as "springs" the components which hold the grid 30 above the frame 10 do not have to be springs in the conventional sense of being compressible and having resilience to return to an uncompressed state. The spring rate of such components may be very low or even zero, and the structure of the foundation 1 effectively rigid between the grid and frame.

The disclosure and invention is not limited by or to the particular type of spring or any other reflexive device or support system between the intermediate frame members 15 and the grid 30. Representative and non-limiting examples of springs which can be used in this manner include those disclosed in the commonly assigned U.S. Pat. Nos. 5,558,315; 5,72,471; 6,134,729; 6,354,577; 6,406,009, and any other spring or reflexive device or devices which could be mounted upon a frame or platform and support a grid or other mattress support structure over the frame or platform.

The grid 30 is supported by the springs 20 over the frame 10 such that the border wire 33 is generally located directly above an outermost edge 100 of the perimeter members 11-14 of the frame 10. A perimeter of the foundation 1 is thus generally defined by a line which extends from the frame edge 100 to the border wire 33 of the grid 30. As noted, in the prior art this area of the foundation has been either completely unsupported or otherwise devoid of structure, or unequally supported by periodically spaced edge springs.

As shown in the Figures, a mattress foundation perimeter structure (or "perimeter structure") is generally indicated at 50. The perimeter structure 50 extends between the frame 10 and the border wire 33. In the representative forms shown, the perimeter structure 50 includes an exterior wall 51 which is generally vertically oriented and substantially flush with the edge 100 of the frame 10, and which may be generally aligned with the border wire 33 of the grid 30, or otherwise vertically aligned with a perimeter region of the grid 30. The perimeter structure 50 is in one preferred form made of foam, such as a homogeneous foam body, which can be molded or extruded in any desired profile which provides the desired structural feature of foam material extending from the frame 10 to a perimeter region of the grid 30 in order to provide flexible and resilient support to the perimeter region of the grid 30. The perimeter structure 50 may be molded as a single homogeneous piece, as for example by injection or poured molding of foam material about the described components of the mattress foundation 1, as further described, or assembled from one or more pre-formed foam components.

Figure 3:
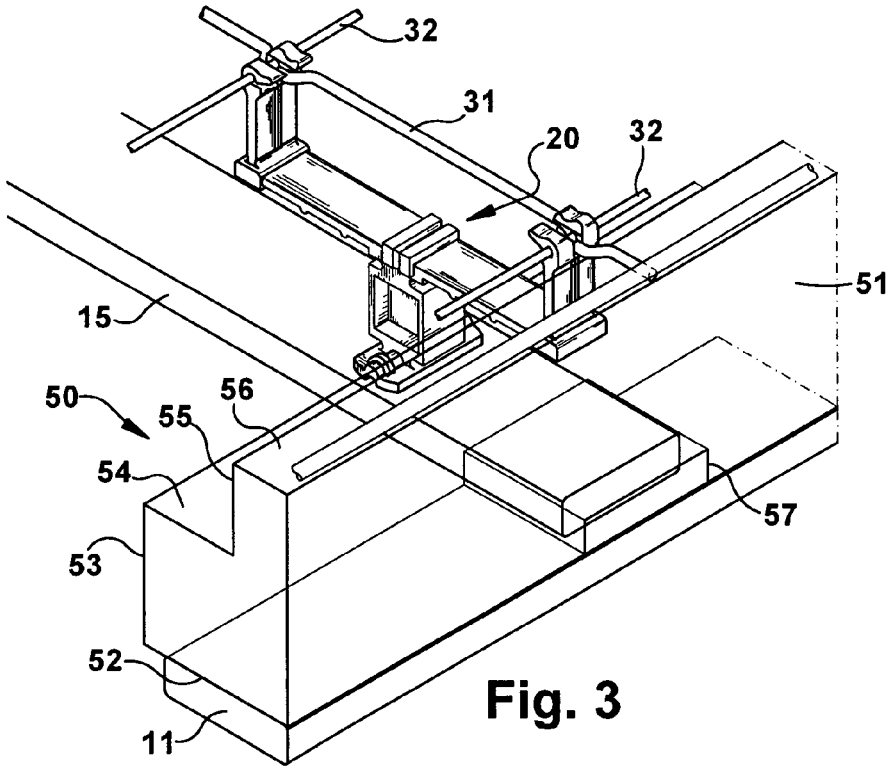
FIG. 3 is a perspective view of a portion of a mattress foundation of the disclosure.
Figure 4:
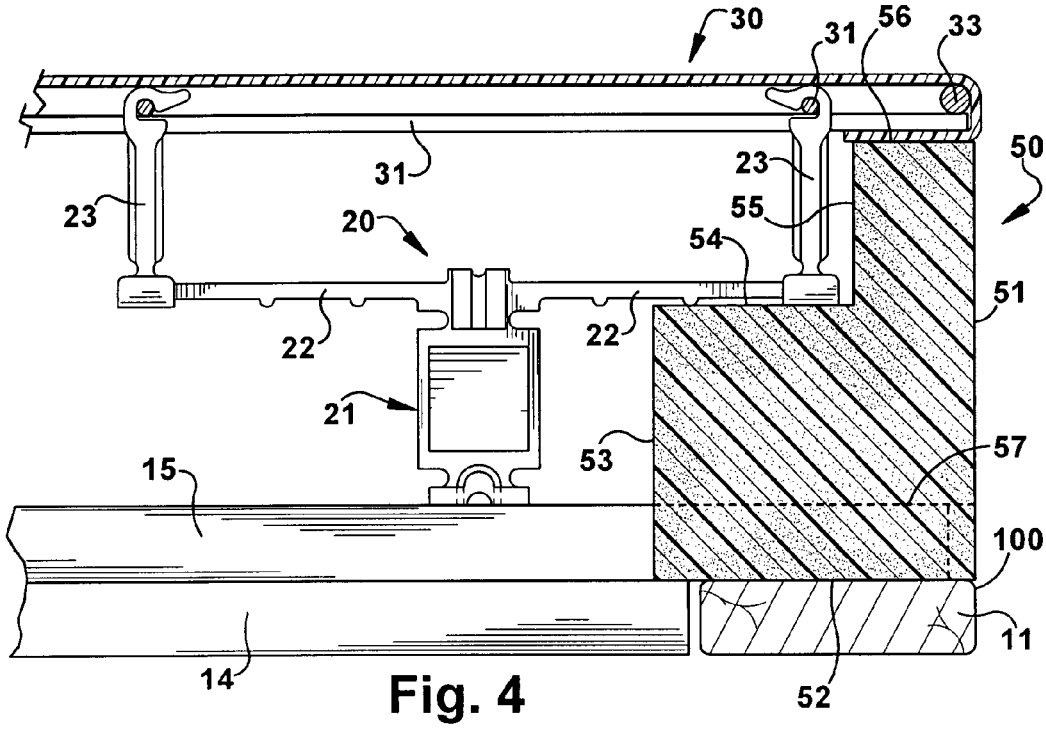
FIG. 4 is an elevation of a portion of a mattress foundation of the disclosure.
Figure 5:
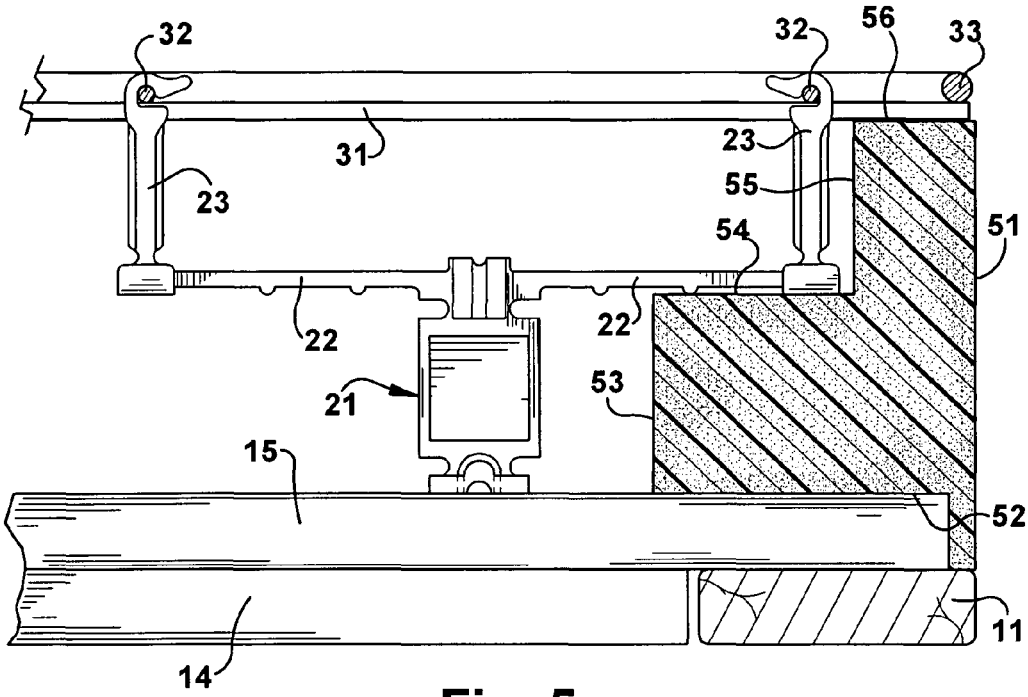
FIG. 5 is an elevation of a portion of a mattress foundation of the disclosure.
Figure 6:
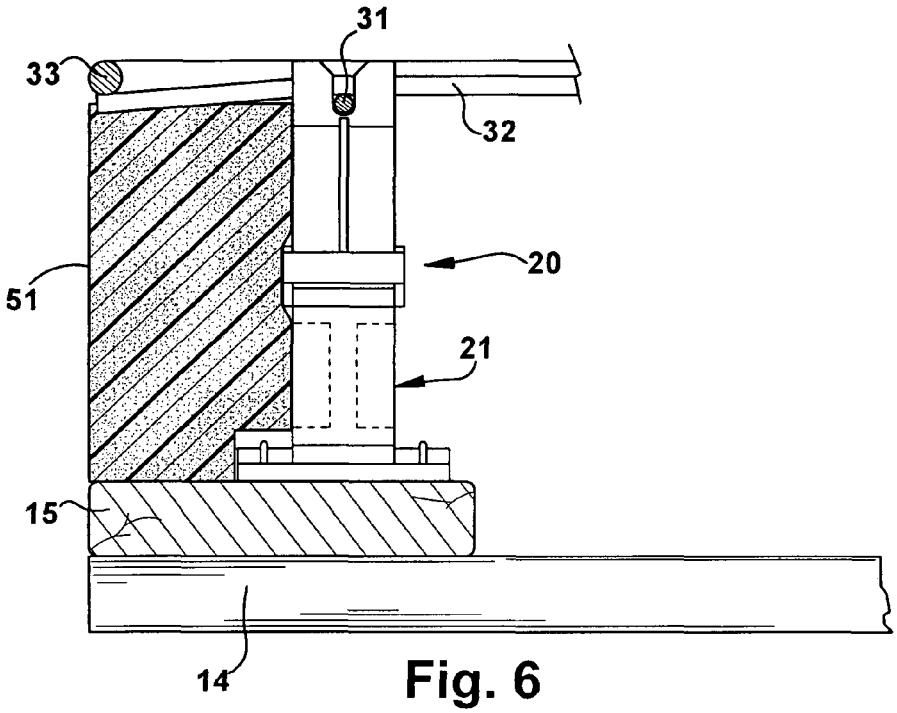
FIG. 6 is an elevation of a portion of a mattress foundation of the disclosure.

As shown in FIGS. 3 and 4, one particular cross-sectional profile of the perimeter structure 50 may be generally rectangular, with the exterior wall 51 extending from one of the perimeter frame members 11 to the grid 30, a base 52 positioned flush against frame member 11, an interior wall 53 which extends from the base 52 to a spring 20 or as shown to the spring body 22, an interior shelf 54 over which a portion of the spring 20 or spring body 22 extends, and a second interior wall 55 which extends from the interior shelf 54 to the top surface 56 over which a perimeter region of the grid 30 extends. The top surface 56 provides a flexible support structure for the perimeter region of the grid 30 which includes the border wire 33 and the segments of the grid wires 31, 32 which are proximate to the border wire 33. As referred to herein, the perimeter region of the grid 30 is any region of the grid 30 which is supported directly or indirectly by the perimeter structure 50.

Figure 2:
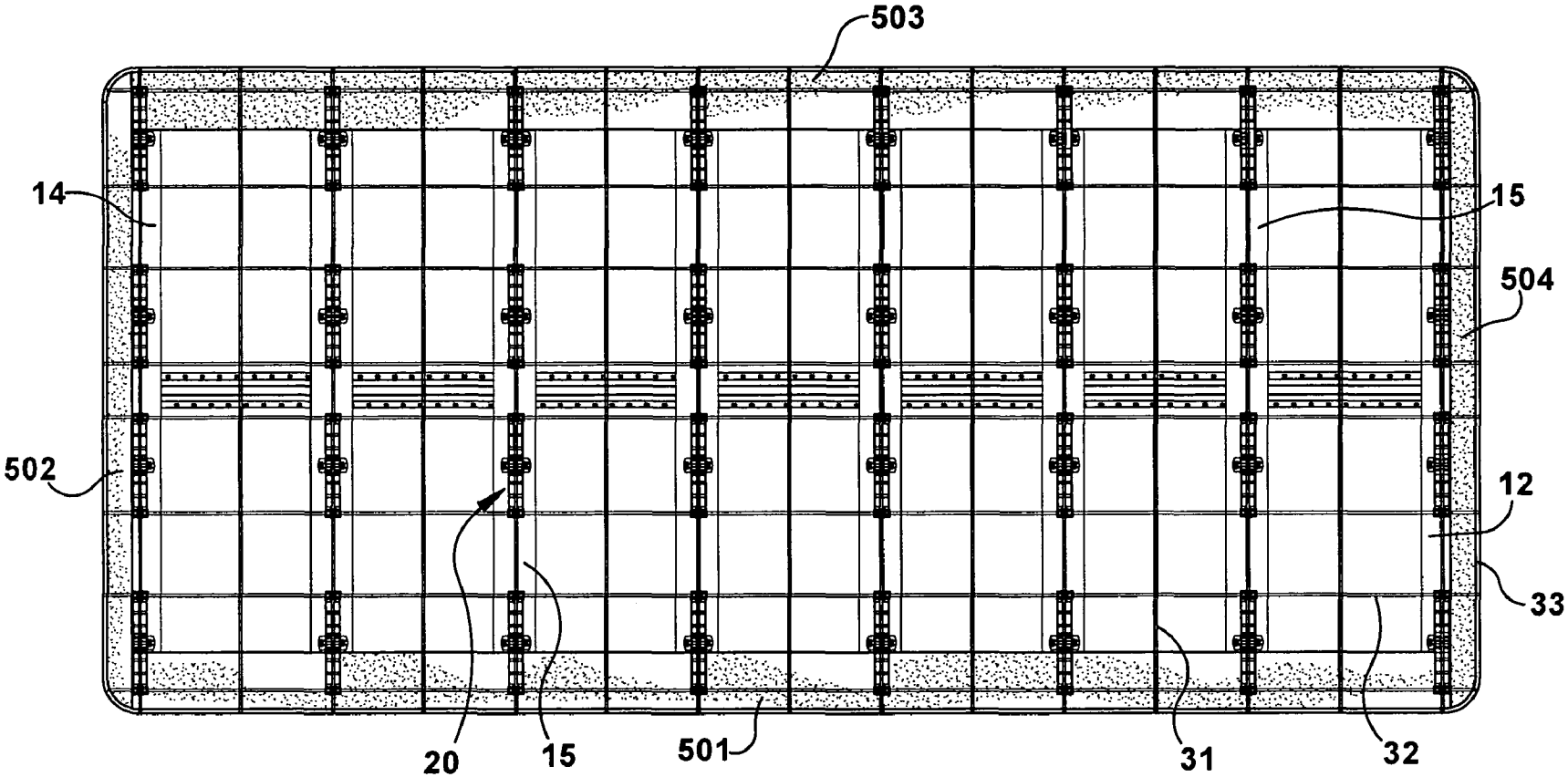
FIG. 2 is a top view of the mattress foundation of FIG. 1.

As mentioned, the perimeter structure 50 may be formed by one or more pieces of foam. To be formed as a single piece or structure, the perimeter structure 50 may be molded separately or in place and assembled with the frame, springs and border wire of the mattress foundation. To be molded in place as a single piece structure, the perimeter structure 50 can be formed by pouring or injection of uncured foam material about the perimeter regions of the frame and border wire. An internal mold wall, positioned inside of the frame and border wire, can be used to prevent migration of the foam material beyond the perimeter region. The perimeter structure 50 can alternatively be made of one or more perimeter structure pieces (or "perimeter pieces") 501, 502, 503, 504 as shown in FIGS. 1 and 2, which may be molded or extruded as single or multiple pieces for each side of the foundation 1, and to correspond with the substantial lineal extent of each of the frame members 11, 12, 13 and 14. In one preferred form, the perimeter structure pieces 501, 502, 503 and 504 are made of closed cell polyurethane foam which is extruded with a desired cross-sectional configuration which extends from the frame members to the grid, and which forms the exterior wall 51. The dimensions and configurations of the perimeter structure pieces 501, 502, 503, 504, and any additional pieces as may be required or used to make up the perimeter structure 50, can be designed to fit and work with a foundation of any type and size. For example, regardless of the height of the foundation as measured from the tops of the frame member 11, 12, 13 and 14 to the grid 30, the perimeter structure pieces 501, 502, 503 and 504 can be made to match that dimension so that the exterior wall 51 extends substantially the entire distance therebetween. Also, the configuration of the perimeter structure pieces apart from the exterior wall 51, such as the described base 52, interior wall 53, shelf 54, second interior wall 55 and top surface 56, can be dimensioned and configured to fit with any type of frame and any type of spring or other support structure for the grid 30.

The perimeter pieces 501, 502, 503, 504 may be fit in position with the frame 10 and grid 30 by placement and/or friction, and held in place by internal covering or upholstery which prevents outward dislodgement or displacement of any of the pieces, while the springs in the perimeter region and proximate to the border wire prevent displacement of the pieces inward. The assembly of the mattress foundation 1 thus needs no special fasteners or securement for the perimeter pieces of the perimeter structure 50, although fasteners can be employed which engage one or more of the pieces and secure them to either the frame, the grid, and of the springs or to two or more such parts of the mattress foundation.

In the particular example illustrated in FIGS. 1-6, which is merely representative of one way in which the principles and concepts of the disclosure may be executed, the perimeter structure 50 is configured to fit with a foundation 1 which includes springs or spring modules 20, which have laterally extending spring arms 22, one of which, at the perimeter of the foundation, extends over the interior shelf 54 of the perimeter structure pieces 501 and 503. In this manner the perimeter structure 50 is partially engaged with or otherwise interacts with or supports one or more of the springs of the foundation, particularly when a load is applied to a perimeter region of the foundation. In the embodiment shown in FIGS. 3-5, the interior shelf 54 and top surface 56 of the perimeter pieces 501, 503 cooperate to provide additional support to the springs and to the perimeter region of the grid 30. owing to the support and reflex properties of the foam from which the perimeter pieces are constructed, the perimeter structure 50 functions as a dynamic structural component of the reflexive support which the foundation 1 provides.

A cut-out or channel 57 may be formed in one of the sides of one or more of the perimeter pieces in order to fit over an intersecting frame member, such as intermediate transverse frame member 15 as shown. As shown in FIG. 4, the cut-out 57 may terminate short of exterior wall 51 in order to maintain the continuity of the surface of exterior wall 51.

Also shown in FIG. 4 is a cover 60, also referred to herein as a "grid cover", which extends over the grid 30, over what may be considered a top or supporting side of the grid 30. At the edge of the grid 30, i.e. at the border wire 33, the cover 60 extends or wraps around the border wire 33 to the underside of the grid 30 in the perimeter region of the grid 30 and opposed to the top surface 56 of the perimeter structure 50, i.e., perimeter piece 501. Frictional contact between the cover 60 and the top surface 56 of the perimeter piece 501 may be sufficient to grip and hold the cover in this position, for the overlay of additional padding and/or upholstery. The cover may be any suitable woven or non-woven material is sheet form. Alternatively, the cover 60 may extend around the border wire 33 and over the exterior wall 51, partially or all the way down to the frame 10.

Another example of shaping or contouring of the perimeter structure 50 is at the corners 58, as shown in FIG. 1, which may be curved or otherwise contoured to follow the profile of the frame corners and the joints of the perimeter frame members 11, 12, 13, 14. Such shaping or contouring may be done by molding, cutting or trimming as known in the art. Where the perimeter structure pieces 501, 502, 503, 504 are made as continuous die extrusions of foam, the pieces may be fit and adhered or welded together at the joint lines 59 to unify the perimeter structure 50. The end perimeter structure pieces 502 and 504 may be trimmed to the profile of the frame perimeter before or after such assembly. The exterior wall 51 is preferably slightly compressed between the frame members and the border wire 33 to provide a friction fit.

The exterior wall 51 of the perimeter structure 50 provides a continuous vertical profile to the entire perimeter of the foundation 1, and creates a substantially flush vertical wall surface at the perimeter over which padding and/or upholstery is applied. The surface of the exterior wall 51 further provides a structural backing for the application of padding or upholstery, which gives the foundation, and particularly the sides of the foundation, a neater finished appearance. Also, the foam of the perimeter structure 50 can serve as an anchoring medium to receive fasteners such as staples for the securement of upholstery or other components to the foundation, the staples or fasteners engage with the matrix of the cells of the foam.

Figure 7:
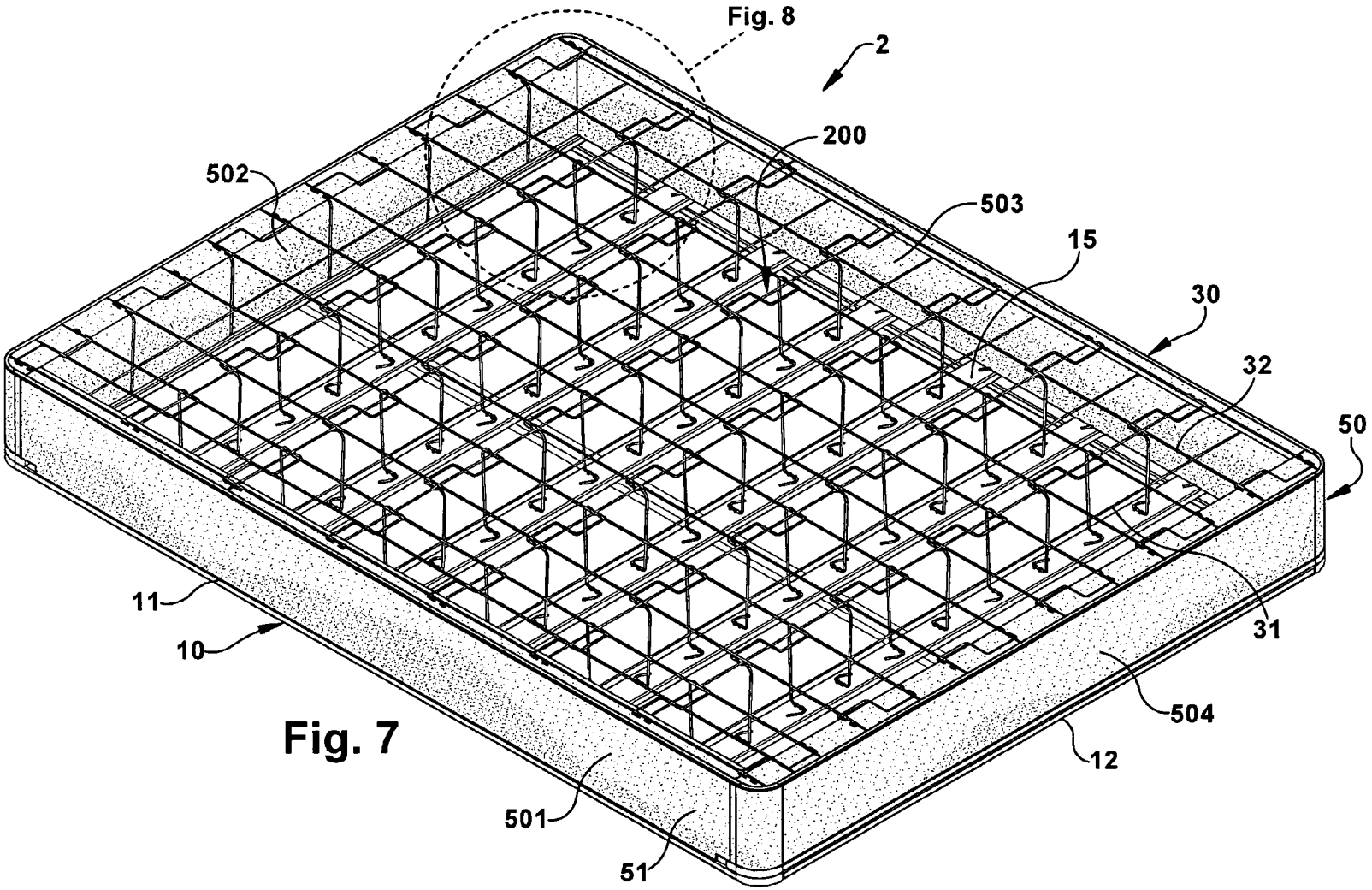
FIGS. 7 and 8 are perspective whole and partial views of an alternate embodiment of a mattress foundation of the disclosure.
Figure 8:
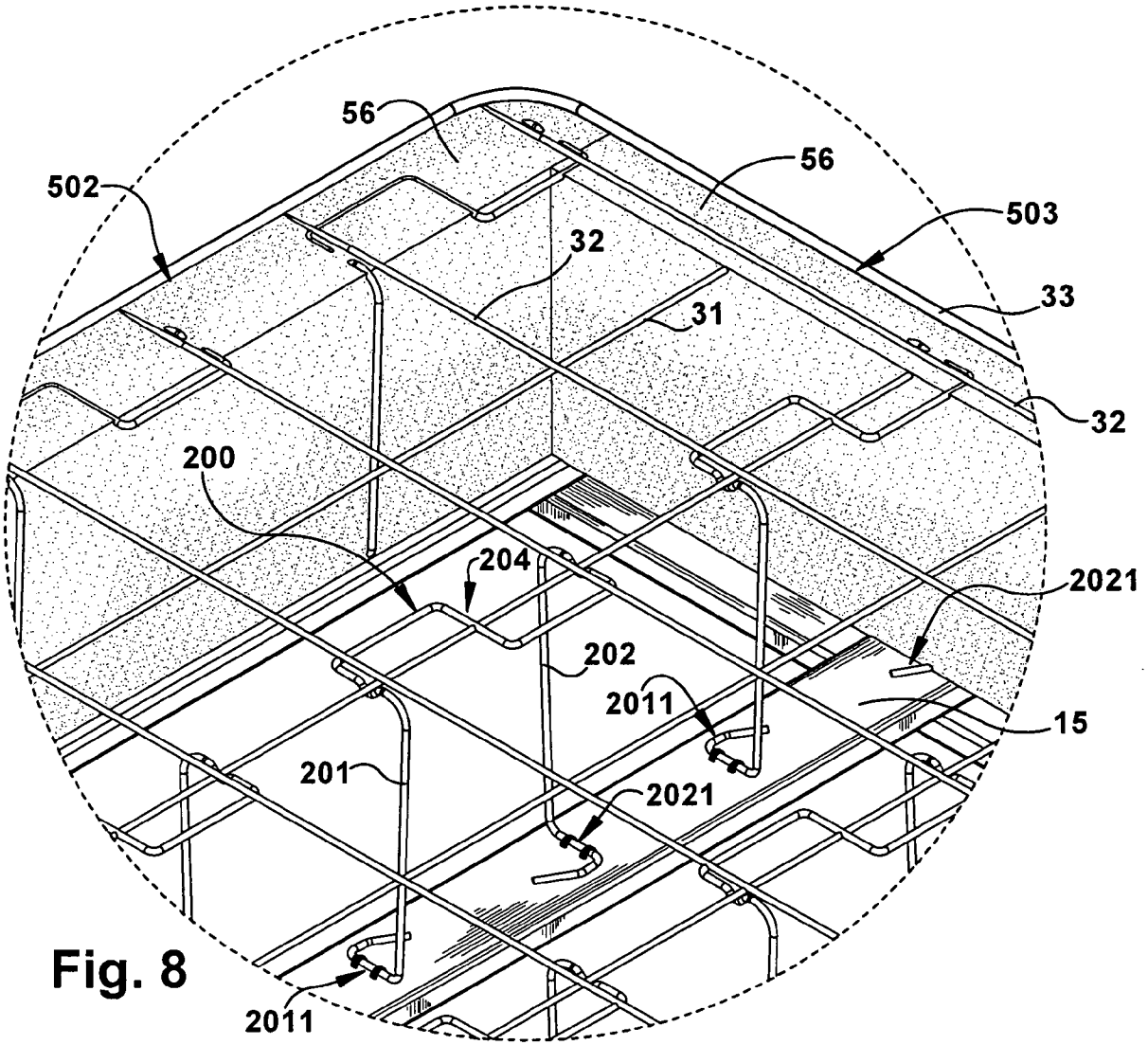

FIGS. 7 and 8 illustrate an alternate embodiment of the disclosure, wherein a mattress foundation, indicated in its entirety at 2, is similarly constructed with a frame 10 and grid 30, and with a different type of springs 200 supporting the grid 30 over the frame 10. The springs 200 of the steel wire torsion spring type known in the art, with one or more legs 201, 202 each with corresponding bases 2011, 2021 which are mounted to the intermediate frame members 15. The legs 201, 202 may be substantially straight or have multiple turns or bends, and some vertical or linear extent to elevate the grid 30 over the frame 10. The tops or heads 204 of the springs 200, which may include one or more turns or bends and generally lie in a plane which is perpendicular to the legs 201, 202, are engaged with the intermediate wires 31 and 32 of the grid 30, by under- or over-lapping arrangement as known in the art.

At the perimeter region of the grid 30 where the perimeter structure 50 is located, and where the top surfaces 56 of the perimeter pieces are proximate to the grid 30 and border wire 33, the tops 204 of the springs 200 extend over and are proximate to or in contact with the top surfaces 56 of one or more of the perimeter structure pieces 501, 502, 503, 504. In this manner the perimeter pieces provide structural and reflexive support to the perimeter region of the grid and mechanically cooperate with the springs at the perimeter of the grid. The perimeter pieces 501, 502, 503 and 504 extend substantially the entire distance from the frame 10, and specifically the top surfaces of the perimeter frame members 11, 12, 13 and 14, to the perimeter region of the grid 30 and to the border wire 33, thereby providing the exterior wall 51 as previously described.

The invention claimed is:

1. A mattress foundation comprising:

a frame having perimeter members which define a perimeter of the frame and intermediate members which extend between the perimeter members of the frame;

springs mounted upon the intermediate members of the frame, the springs attached to and supporting a grid above the frame;

the grid having a border wire generally aligned with the perimeter of the frame and intermediate wires which extend between the border wire, the springs attached to the intermediate wires of the grid;

a solid, single, generally L-shaped perimeter structure which extends between the perimeter members of the frame to a perimeter region of the grid, the perimeter structure having a base supported by the perimeter members of the frame, and a top surface which extends only along the perimeter of the grid, proximate to the border wire.

2. The mattress foundation of claim 1, wherein the perimeter structure has an exterior wall which extends from the perimeter of the frame to the border wire of the grid.

3. The mattress foundation of claim 1, wherein the perimeter structure has an interior shelf that protrudes outward from the body of the perimeter structure and is located proximate to one or more springs.

4. The mattress foundation of claim 1, wherein the perimeter structure fits over one or more of the intermediate frame members where the intermediate frame members intersect with the perimeter frame members.

5. The mattress foundation of claim 1, wherein the perimeter structure substantially covers a top surface of the perimeter frame members.

6. The mattress foundation of claim 1, wherein a segment of a leg of one or more of the springs is proximate to a top surface of the perimeter structure.

7. The mattress foundation of claim 1, wherein the perimeter structure is comprised of at least four pieces which correspond with at least four perimeter frame members.

8. The mattress foundation of claim 7, wherein the pieces of the perimeter structure are attached to each other.

9. The mattress foundation of claim 1, wherein the border wire of the grid is located over the top surface of the perimeter structure.

10. The mattress foundation of claim 1 further comprising a grid cover which extends over the grid and around at least a portion of the border wire of the grid and over a portion of an underside of the grid opposed to a top surface of the perimeter structure.

11. The mattress foundation of claim 1, wherein the perimeter structure has an exterior wall which extends from an outermost edge of the perimeter frame members to the border wire.

12. The mattress foundation of claim 11, wherein the perimeter structure extends from the exterior wall to springs which are located closest to the border wire of the grid.

13. A mattress foundation comprising:

a frame having perimeter members which define a perimeter of the frame, and intermediate members which extend between the perimeter members of the frame;

springs mounted upon the intermediate members of the frame, the springs attached to and supporting a grid above the frame;

the grid having a border wire generally aligned with the perimeter of the frame, and intermediate wires which extend between the border wire, the springs attached to the intermediate wires of the grid;

a solid foam perimeter structure which extends between the perimeter members of the frame to a perimeter region of the grid, the perimeter structure made up of solid perimeter structure pieces, each solid perimeter structure pieces having a base supported by one of the perimeter members of the frame, a top surface proximate to a perimeter region of the grid and the border wire of the grid, a first interior wall that extends vertically between the base and a horizontally oriented interior shelf and a second interior wall that extends vertically between the horizontally oriented interior shelf and the top surface of the perimeter structure;

wherein the solid foam perimeter structure has an L-shaped cross-section with a height dimension that is greater than the width.

14. The mattress foundation of claim 13, wherein each of the perimeter structure pieces of the perimeter structure have a common profile which includes a base and a top surface, an exterior wall which extends from the base to the top surface and an interior wall.

15. The mattress foundation of claim 13, wherein the perimeter structure pieces of the perimeter structure are made of closed-cell polyurethane foam.

16. The mattress foundation of claim 13, wherein the exterior wall of each of the perimeter structure pieces is generally aligned with an outermost edge of the perimeter members of the frame and with the border wire of the grid.

17. The mattress foundation of claim 13, wherein the perimeter structure pieces of the perimeter structure are located proximate to a perimeter region of the grid and proximate to springs which are closest to the border wire of the grid.

18. The mattress foundation of claim 13, wherein the perimeter structure pieces of the perimeter structure have a generally rectangular cross-sectional configuration.

19. The mattress foundation of claim 13, wherein the perimeter structure pieces of the perimeter structure are in frictional contact with the frame and the grid.

20. The mattress foundation of claim 13 further comprising a grid cover which extends over the grid and the border wire.

21. The mattress foundation of claim 13 further comprising a grid cover which extends over the grid and around the border wire and between the border wire and top surfaces of the perimeter structure pieces of the perimeter structure.

22. A mattress foundation comprising:

a frame having four perimeter members and intermediate members which extend between the perimeter members;

a plurality of springs on the intermediate members of the frame, each of the springs attached to a grid positioned over the frame;

the grid having a border wire generally aligned with the perimeter members of the frame, and intermediate wires which extend between the border wire, the springs attached to the intermediate wires of the grid;

a perimeter structure between the perimeter members of the frame and the border wire of the grid, the perimeter structure including one or more solid perimeter pieces, the solid perimeter pieces having a cross-sectional configuration which includes an exterior wall located between the perimeter members of the frame and the border wire of the grid, an interior wall extending between the perimeter members of the frame and an interior shelf and a second interior wall extending between the interior shelf and the top surface of the perimeter structure, the top surface of the perimeter structure only extending along the perimeter of the support grid proximate to the border wire.

23. The mattress foundation of claim 22, wherein the perimeter structure is a single perimeter piece which is molded in place with the frame, springs, grid and border wire.

24. The mattress foundation of claim 22, wherein the perimeter structure includes multiple perimeter pieces.

25. The mattress foundation of claim 22, wherein the exterior wall of the perimeter structure is compressed between the frame and the border wire.

26. A mattress foundation assembly comprising a frame with perimeter members and intersecting intermediate members with ends which are attached to the perimeter members;

a plurality of springs which extend from the intermediate members of the frame to an overlying grid, the grid having orthogonal intersecting rods or wires, and a border wire which runs continuously about an entire perimeter of the grid;

each spring of the plurality of springs having a base which is mounted upon a supporting surface of an intermediate frame member, a spring body, and a grid-supporting end configured to engage or otherwise connect with a grid which is positioned over the springs and the frame, the grid having a plurality of intersection rods or wires within a border wire, and wherein the springs engage and support the grid generally proximate to intersections of the intersecting rods or wires;

and whereby the grid is supported by the springs over the frame such that the border wire of the grid is generally located directly above an outermost edge of the perimeter members of the frame, and a perimeter of the foundation is generally defined by a line which extends from the frame edge to the border wire of the grid;

a mattress foundation perimeter structure extending between the frame and the border wire, the mattress foundation perimeter structure having an exterior wall which is generally vertically oriented and substantially flush with the edge of the frame, and which is generally aligned with the border wire of the grid, or otherwise vertically aligned with a perimeter region of the grid, the mattress foundation perimeter structure comprised of a substantially homogeneous foam body to provide foam material which extends from the frame to a perimeter region of the grid in order to provide flexible and resilient support to the perimeter region of the grid;

the mattress foundation perimeter structure having a cross-section configuration which is generally rectangular, including an exterior wall which extends from one of the perimeter frame members to the grid, a base positioned flush against the frame member, an interior wall which extends from the base to a spring, and a second interior wall which extends from the base to the top surface over which a perimeter region of the grid extends, the top surface of the perimeter structure providing a flexible support structure for the perimeter region of the grid which includes the border wire and the segments of the grid wires which are proximate to the border wire;

wherein, in a cross-section of the perimeter structure, the height dimension of the perimeter structure is greater than the width dimension.

27. The mattress foundation assembly of claim 26, wherein the springs have laterally extending spring arms, and wherein at least one of the laterally extending arms of the springs located proximate to a perimeter of the foundation extends over an interior shelf of the perimeter structure, whereby the perimeter structure is partially engaged with or otherwise interacts with or supports one or more of the springs of the foundation.

* * * * *